US006761386B2

(12) United States Patent
Mandle et al.

(10) Patent No.: US 6,761,386 B2
(45) Date of Patent: Jul. 13, 2004

(54) HOLDER FOR SCOURING DEVICE

(75) Inventors: James S. Mandle, Woodcliff Lake, NJ (US); Charles F. Flynn, IV, Oak Ridge, NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 0 days.

(21) Appl. No.: 09/844,963

(22) Filed: Apr. 27, 2001

(65) Prior Publication Data

US 2002/0158481 A1 Oct. 31, 2002

(51) Int. Cl.[7] ..... B25J 1/02
(52) U.S. Cl. ..... 294/99.2; 294/93; 15/229.13
(58) Field of Search ..... 294/93, 99.2, 15, 294/16, 33, 61; 15/149, 229.13, 244.1; 16/422

(56) References Cited

U.S. PATENT DOCUMENTS

| | | | | | |
|---|---|---|---|---|---|
| 209,989 | A | * | 11/1878 | Shinn | 294/93 |
| 2,234,715 | A | * | 3/1941 | Whitney | 294/93 |
| 2,512,952 | A | * | 6/1950 | MacMartin | 15/229.13 |
| 2,518,873 | A | * | 8/1950 | Eisenberg et al. | 15/229.13 |
| 2,529,434 | A | * | 11/1950 | Walker | 15/229.13 |
| 3,015,118 | A | * | 1/1962 | Strader | 15/229.13 |
| 3,201,815 | A | * | 8/1965 | Selby | 294/93 |
| 3,413,673 | A | * | 12/1968 | Gewirz | 15/229.13 |
| 4,877,280 | A | * | 10/1989 | Milano | 294/99.2 |
| 5,421,630 | A | * | 6/1995 | Sergi et al. | 294/93 |

FOREIGN PATENT DOCUMENTS

| | | | | |
|---|---|---|---|---|
| DE | 3530401 | * | 7/1986 | 15/229.113 |
| FR | 711452 | * | 9/1934 | 15/229.13 |

* cited by examiner

*Primary Examiner*—Dean J. Kramer

(57) ABSTRACT

A holder for a scouring device such as a steel wool pad which includes a base, a pair of opposed legs extending from the base and a gripping assembly positioned at an end portion of each of the opposed legs including a gripping assembly which is moveable by the consumer from a first position sufficient to secure the holder to the steel wool pad to a second position to release the steel wool pad without the user having to touch the steel wool pad during movement from the first position to the second position.

13 Claims, 4 Drawing Sheets

HOLDER FOR SCOURING DEVICE

FIELD OF THE INVENTION

The present invention is generally directed to a holder for a scouring device such as a pad made of plastic or metal in the form of thin strands such as a steel wool pad which employs a gripping assembly such as two rows of oppositely directed teeth such that the holder can engage and disengage the scouring device without the user having to touch the scouring device.

BACKGROUND OF THE INVENTION

Scouring devices such as steel wool pads have been used by consumers for many years. Such devices are particularly advantageous because they can remove hard to remove food products and/or stains and are easily accessible and usable by the consumer.

Scouring devices, however, do present one problem. Since the scouring devices are gripped by the hand, the plastic and/or metal strands that may comprise the scouring device are rough on the hands and may cause minor irritations which are frowned upon by the consumer.

Attempts have been made to provide a holder for a scouring device which enables the consumer to use the same without having to physically handle the scouring device during the cleaning of utensils. Such scouring devices are disclosed, for example, in Schimel (U.S. Pat. No. 2,364,319); Silver (U.S. Pat. No. 4,244,075); Gessert (U.S. Pat. No. 6,192,545); and Payton (U.S. Pat. No. 6,041,466). While such devices are capable of holding a scouring device so that the consumer need not grip the scouring device during a cleaning operation, nonetheless, such devices are disadvantageous because they are bulky, relatively expensive to manufacture and/or require the consumer to handle the scouring device in order to secure the same to the holder.

It would therefore be a significant advance in the art of providing a holder for a scouring device if the holder can grip the scouring device and release the same without the user having to handle the scouring device.

It would be a further advance in the art to provide a holder for a scouring device which is not bulky and is relatively inexpensive to manufacture and easy to operate.

SUMMARY OF THE INVENTION

The present invention is generally directed to a holder for a scouring device which enables the consumer to grip the scouring device in a manner sufficient to provide a gripping force which secures the scouring device to the holder during the cleaning operation and also enables the consumer to release the scouring device when the cleaning operation is completed without having to physically handle the scouring device during the gripping and releasing operations.

In a particular aspect of the present invention, there is provided a holder for a scouring device comprising:

a) a base;

b) a pair of opposed legs extending from the base, each leg comprising a central portion and an end portion; and c) a gripping assembly positioned at the end of each of the opposed legs and including a gripping means movable from a first position sufficient to secure the holder to the scouring device to a second position to release the scouring device without the user having to touch the scouring device during movement from the first position to the second position.

In one particular aspect of the present invention, the gripping means is in the form of opposed rows of teeth wherein each row of teeth extend away from the other row of teeth in a manner which enables the holder to securely grip the scouring device during a cleaning operation and to readily release the same when the scouring device is to be discarded or the like.

BRIEF DESCRIPTION OF THE DRAWINGS

The following drawings in which like reference characters indicate like parts are illustrative of embodiments of the present invention and are not intended to limit the invention as encompassed by the claims forming part of the application.

DETAILED DESCRIPTION OF THE INVENTION

The present invention is generally directed to a holder for a scouring device which is typically in the form of a pad formed of strands of metal (e.g. steel, copper and the like) plastic (e.g. polypropylene), or rubber-like materials and combinations thereof. The most common example of a pad which may be secured by the holder of the present invention is a steel wool pad such as steel wool pads sold under the trademark Brillo.

Figure 1:
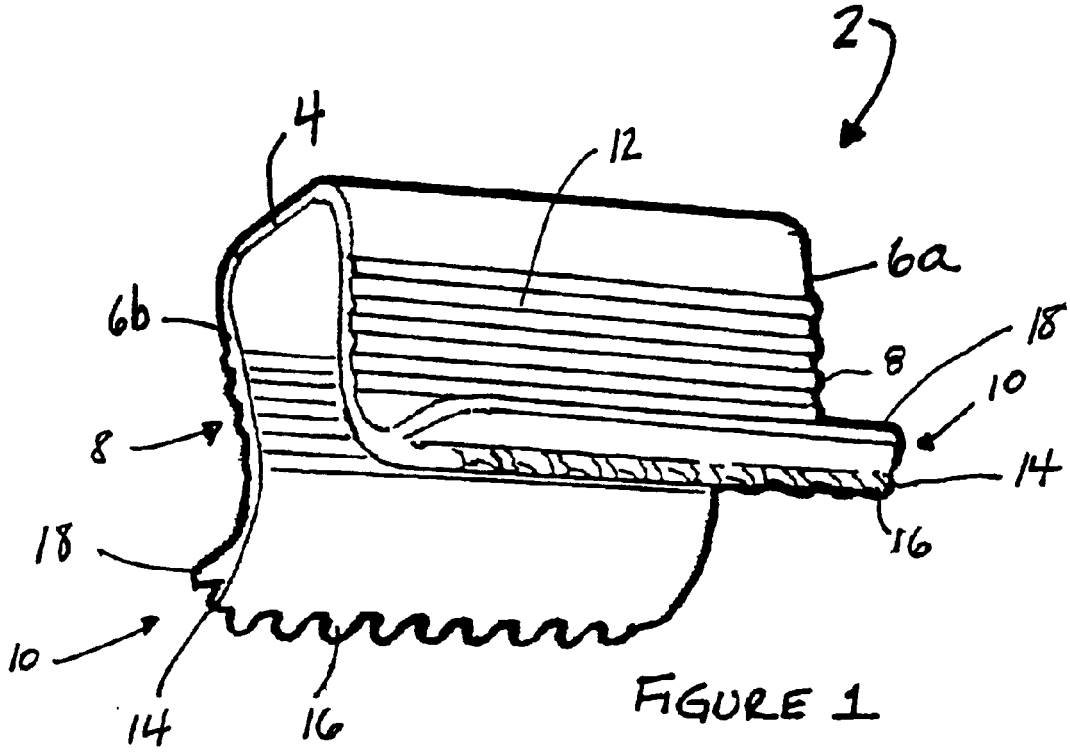
FIG. 1 is a perspective view of an embodiment of a holder for a scouring device in accordance with the present invention.
Figure 2:
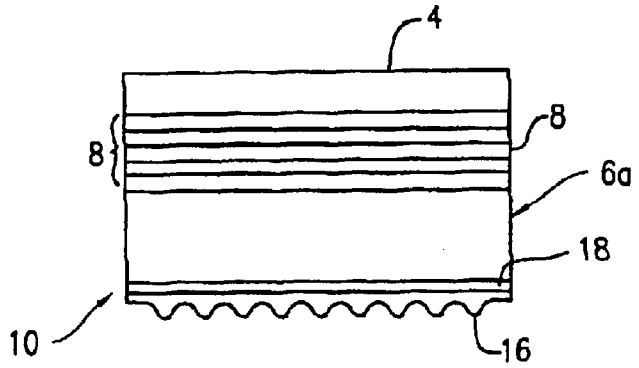
FIG. 2 is a side view of the embodiment of the present invention shown in FIG. 1.
Figure 3:
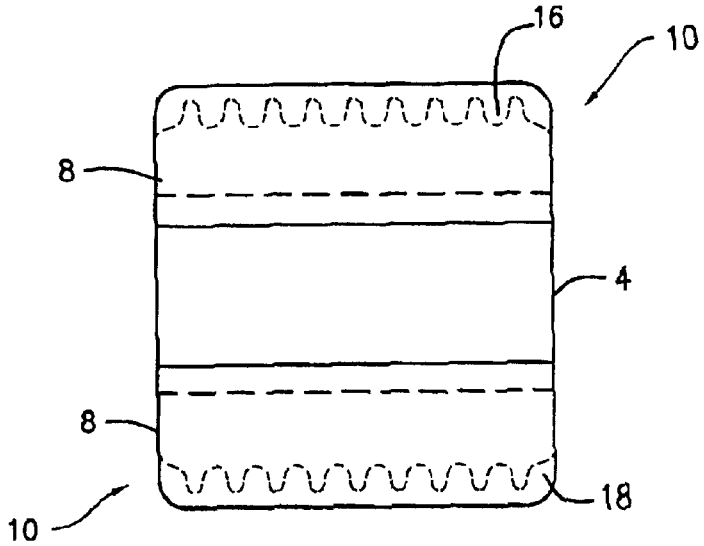
FIG. 3 is a top view of the embodiment of the present invention shown in FIG. 1.
Figure 4:
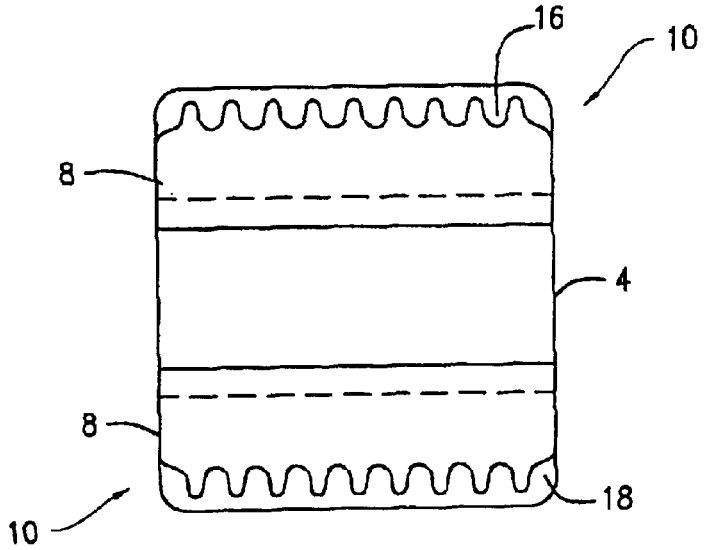
FIG. 4 is a bottom view of the embodiment of the present invention shown in FIG. 1.

Referring to FIGS. 1–4, the holder 2 comprises a base 4 which is shown specifically in FIG. 1 may be flat. It will be understood that the base 4 may assume any other shape such as rounded, curved, or angular.

Extending from the base 4 are a pair of opposed legs 6*a* and 6*b*. The legs include a central portion 8 connected directly to the base 4 and an end portion 10. The central portion 8 of each leg 6*a* and 6*b*, preferably bows inwardly as shown in FIG. 1 to facilitate flexing of the legs during the engaging and disengaging of the scouring device.

The central portion 8 has, in a preferred embodiment of the invention, an uneven surface 12 which facilitates the gripping of the holder by the consumer as described hereinafter.

As specifically shown in FIG. 1, the base 4 and opposed legs 6*a* and 6*b* are preferably made of a flexible plastic such as polypropylene, polyethylene and nylon. It will be understood in accordance with further features of the present invention, the holder 2 can be made in separate parts such as having a base secured to the opposed legs through some securing means such as an adhesive, hinge or the like. However, the holder 2 is preferably made of plastic from a single molded piece having a unitary construction.

The end portion 10 includes a gripping assembly 14 which in the embodiment shown in FIG. 1 of the opposed rows of spaced apart teeth 16. The arrangement of the gripping portion 14 and particularly the arrangement of the teeth 16 on the respective end portions 10 of the holder 2 is an important aspect of the present invention because it provides the ability of the holder 2 to grip a scouring device and release the same solely through the movement of the consumer's fingers when they are secured about the central portion 8 of the opposed legs 6*a* and 6*b*.

Figure 5:
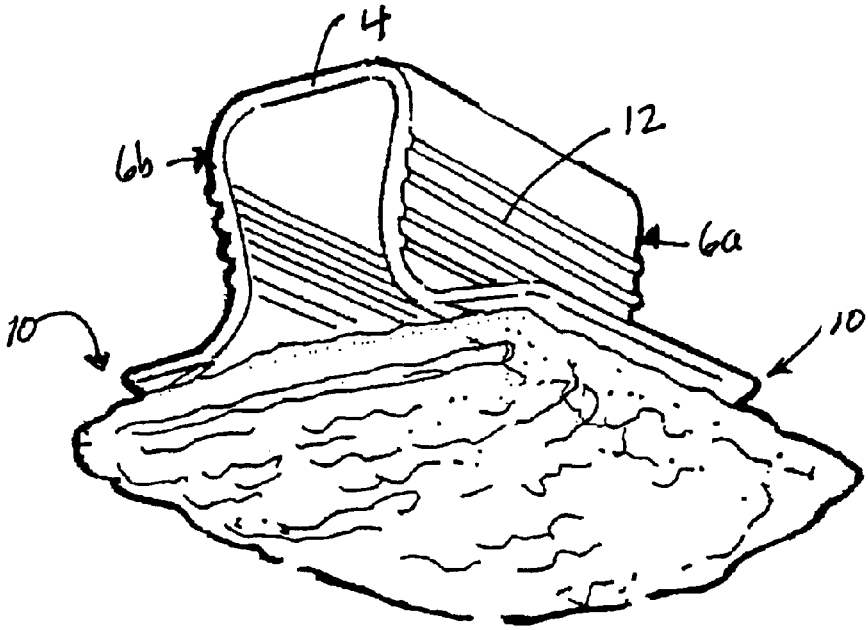
FIG. 5 is a perspective view of the embodiment of the present invention shown in FIG. 1 with a scouring device secured thereto.
Figure 7:
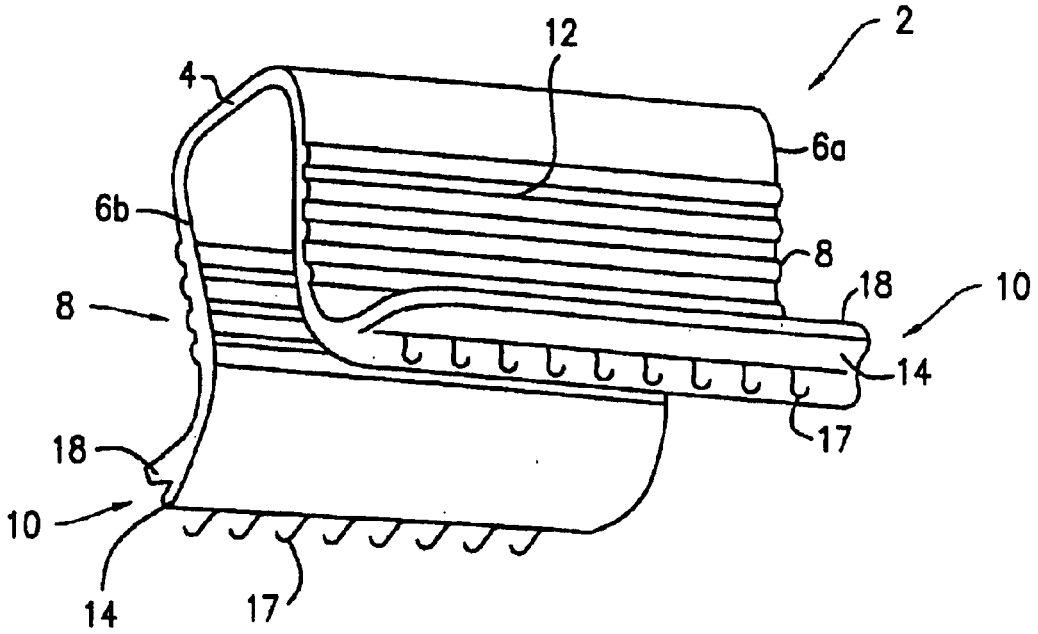
FIG. 7 is a perspective view similar to FIG. 1 showing the use of hooks for gripping the scouring device.

More specifically, the opposed legs 6*a* and 6*b* must be movable from a first position shown in FIG. 1 to a second position which is instigated by the consumer by pressing the respective central portions 8 toward each other which results in reducing the distance between the respective gripping portions 14. Movement of the holder 2 from the first and second positions described above enables the holder 2, particularly the gripping portion 14, to engage the scouring device when the holder 2 is placed in contact therewith. Thus, the consumer takes the holder 2 as shown in FIG. 1 and places the same on top of the scouring device. The consumer then presses the respective central portions 8 of the legs 6*a* and 6*b* towards each other to thereby reduce the distance between the respective gripping portions 14. When the pressure applied by the consumer is released, the teeth 16 of each gripping portion 14 dig into the scouring device particularly into the strands of the scouring device material (e.g. steel wool) to thereby grip the scouring device and retain the same secured to the device 2 as shown in FIG. 5. It will be understood that a variety of gripping means may be employed such as hooks and the like as shown in FIG. 7.

When the holder 2 is secured to the scouring device as shown in FIG. 5, the consumer maintains contact with the holder 2 by the fingers which rest against respective central portions 8 and particularly the uneven surface 12 constituting the outside surface of the central portions 8. The consumer may then clean or scour a utensil in the position shown in FIG. 5.

When the cleaning or scouring operation is completed, the consumer may then remove the scouring device from the holder 2 by simply reapplying pressure to the respective central portions 8 inwardly thereby bringing the gripping portions 14 once again closer to each other. As a result, the teeth 16 of the gripping portions 14 disengage from the strands of the scouring device releasing the scouring device from contact with the holder 2.

In a preferred form of the invention, the respective end portions 10 of the device 2 are provided with a finger guard 18 which lies above and extends out over the teeth 16 of the gripping portion 14. The finger guard 18 prevents the consumer's fingers from contacting the teeth 16, especially during the cleaning operation.

As previously indicated, the base 4 is preferably in the form of a flat surface. The flat surface provides a means of supporting the holder 2 while the holder is still engaged to the scouring device.

Figure 6:
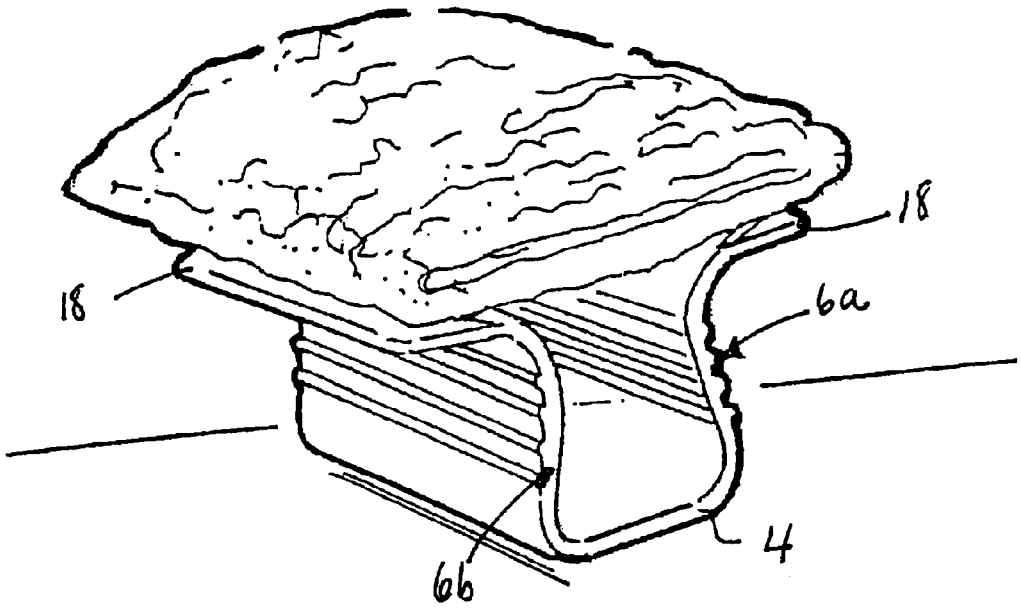
FIG. 6 is a perspective view of the embodiment of the invention shown in FIG. 5 with the device inverted and resting on its base with the scouring device secured thereto.

Referring to FIG. 6, the base 4 has a flat surface that can easily rest on a corresponding flat surface such as a table top and the like. The holder 2 easily rests on the table top while maintaining the scouring device attached thereto. This enables the consumer to store a used scouring device without the scouring device contacting the table top or other surface.

What is claimed is:

1. A holder for a scouring device comprising:

a) a base;

b) a pair of opposed flexible legs extending from the base and being movable toward each other by the application of pressure by a user, each opposed flexible leg comprising a central portion and an end portion; and c) a gripping assembly positioned at the end portion of each of the opposed flexible legs and including a gripping means comprising a finger guard having an upper surface for placement of the fingers of the user and a lower surface, a plurality of spaced apart grippers extending away from the lower surface movable in unison from a first position by the application of pressure by the fingers of the user to the pair of opposed flexible legs sufficient to enter the scouring device at the same time to secure the holder to the scouring device wherein the scouring device is held by the holder without the application of pressure by the user, to a second position wherein the user maintains pressure on the holder to release the grippers at the same time from the scouring device without the user having to touch the scouring device during movement from the first position to the second position.

2. The holder of claim 1 wherein the gripping means comprises a plurality of spaced apart teeth.

3. The holder of claim 1 wherein the gripping means comprises a plurality of hooks.

4. The holder of claim 1 wherein the base, the opposed flexible legs and the gripping assembly have a unitary construction.

5. The holder of claim 1 wherein the central portion of the opposed flexible legs comprises a gripping section wherein one of said opposed flexible legs is engaged by a user's thumb and the other of said opposed flexible legs is engaged by at least one finger of the same hand as the user's thumb.

6. The holder of claim 5 wherein the opposed flexible legs extend toward each other at the central portion.

7. The holder of claim 6 wherein the opposed flexible legs extend away from each other at the end portions thereof.

8. The holder of claim 7 wherein the finger guard extends in a plane substantially horizontally to an upper surface of the holder.

9. The holder of claim 1 wherein the base lies in a plane substantially parallel to an upper surface of the scouring device.

10. The holder of claim 1 wherein the central portion of the opposed flexible legs has an uneven surface to facilitate operative engagement of the holder by the user.

11. The holder of claim 1 wherein the holder is made from at least one flexible material selected from the group consisting of plastic, metal and rubber.

12. A method of gripping a scouring device comprising:

1) placing the scouring device in contact with a holder comprising:

a) a base;

b) a pair of opposed flexible legs extending from the base and being movable toward each other by the application of pressure by a user, each opposed flexible leg comprising a central portion and an end portion; and c) a gripping assembly positioned at the end portion of each of the opposed flexible legs and including a gripping means comprising a finger guard having an upper surface for placement of the fingers of the user and a lower surface, a plurality of spaced apart grippers extending away from the lower surface movable in unison from a first position by the application of pressure by the fingers of the user to the pair of opposed flexible legs sufficient to secure the holder to the scouring device wherein the scouring device is held by the holder without the application of pressure by the user to a second position wherein the user maintains pressure on the holder to release the grippers at the same time from the scouring device without the user having to touch the scouring device during movement from the first position to the second position, 2) applying pressure to the opposed flexible legs at said central portion to bring the opposed flexible legs closer together, and 3) releasing the pressure on the opposed flexible legs to thereby enable the gripping means to move to said first position to secure the holder to the scouring device.

13. The method of claim 12 further comprising:

applying pressure to the opposed flexible legs at said central portion to bring the opposed flexible legs closer together a sufficient distance so that the gripping means moves to the second position thereby releasing the scouring device from the holder.

* * * * *